US007681931B2

(12) United States Patent
Demus

(10) Patent No.: US 7,681,931 B2
(45) Date of Patent: Mar. 23, 2010

(54) BARKERSVILLE SCOOPER DEVICE

(76) Inventor: Roderick Lee Demus, 5111 Skillman #225, Dallas, TX (US) 75206

( * ) Notice: Subject to any disclaimer, the term of this patent is extended or adjusted under 35 U.S.C. 154(b) by 0 days.

(21) Appl. No.: 11/369,214

(22) Filed: Mar. 6, 2006

(65) Prior Publication Data

US 2006/0243866 A1 Nov. 2, 2006

(51) Int. Cl.
*A01K 29/00* (2006.01)
*E01H 1/12* (2006.01)

(52) U.S. Cl. ..... 294/1.4; 294/55

(58) Field of Classification Search ..... 294/1.1, 294/1.3, 1.4, 1.5, 55; 15/257.1, 257.6, 257.7
See application file for complete search history.

(56) References Cited

U.S. PATENT DOCUMENTS 4,466,647 A * 8/1984 Spevak ..... 294/1.5
4,641,873 A * 2/1987 Nurnberger ..... 294/1.4
4,741,566 A * 5/1988 Byung-Do et al. ..... 294/1.4
6,135,520 A * 10/2000 Miller et al. ..... 294/1.4

* cited by examiner

*Primary Examiner*—Dean J Kramer
(74) *Attorney, Agent, or Firm*—Delphine James

(57) ABSTRACT

The present is invention is a refuse collector device for collecting feces waste material from the ground. The device comprises a shaft having an upper end and a lower end with an internal bore extending therethrough. An extension rod extends through the internal bored from the upper end to the lower end of the shaft. The extension rod is defined by a top and a bottom. A handle is fixably mounted to the upper end of the shaft. An actuator device is operationally mounted to the handle and is operationally connected to the top of the extension rod. A protective sleeve is configured to surround and to slidably engage with the shaft. A bag holder is pivotally mounted to the lower end of shaft. A shovel is pivotally connected to the bottom of extension rod facing the bag holder such that when activated by a user the actuator device causes the shovel to automatically move foreword scooping the feces waste material up and into the bag holder.

10 Claims, 7 Drawing Sheets

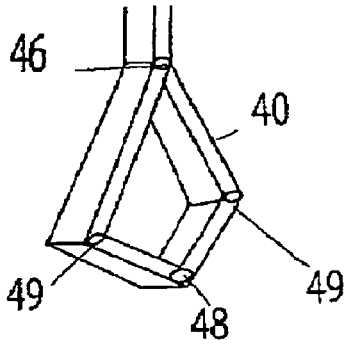
FIGURE 3d
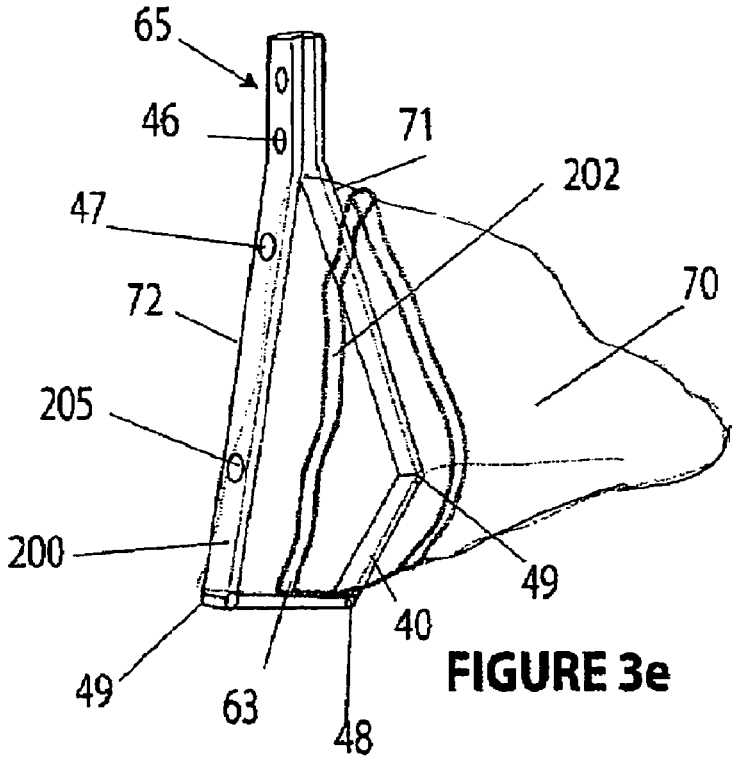
FIGURE 3e
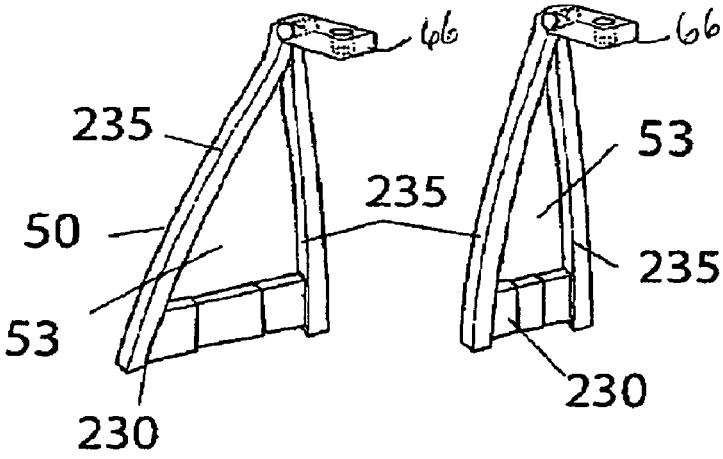
FIGURE 4c
FIGURE 4d

BARKERSVILLE SCOOPER DEVICE

BACKGROUND

This invention relates to refuse collector devices for animal waste. Today many people live in urban areas. In most cases, owners of pets are responsible for the sanitary and Cleanliness of their pets. Some cities have ordinances-regarding sanitary pickup of pet feces. There are several examples in the prior art Of refuse collector devices, for example, U.S. Pat. No. 4,995,661 discloses a device for picking of animal waste in a sanitary manner. The waste is trapped in a small bag attached to flexible stays controlled by a handle. Similarly, U.S. Pat. No. 6,736,436 discloses a refuse collection bag retention mechanism that includes a tubular portion to which a bag mount is attached.

However, the present invention provides a uniquely design compact animal waste collector device.

BRIEF DESCRIPTION OF DRAWINGS

FIG. 3D is a side view of the bag holder connection points.

FIG. 3E is a side view of the bag attached to the bag holder in the open position.

FIG. 4C is exploded view of shovel contracted.

FIG. 4D is exploded view of the shovel released.

DETAILED SPECIFICATION

Figure 1:
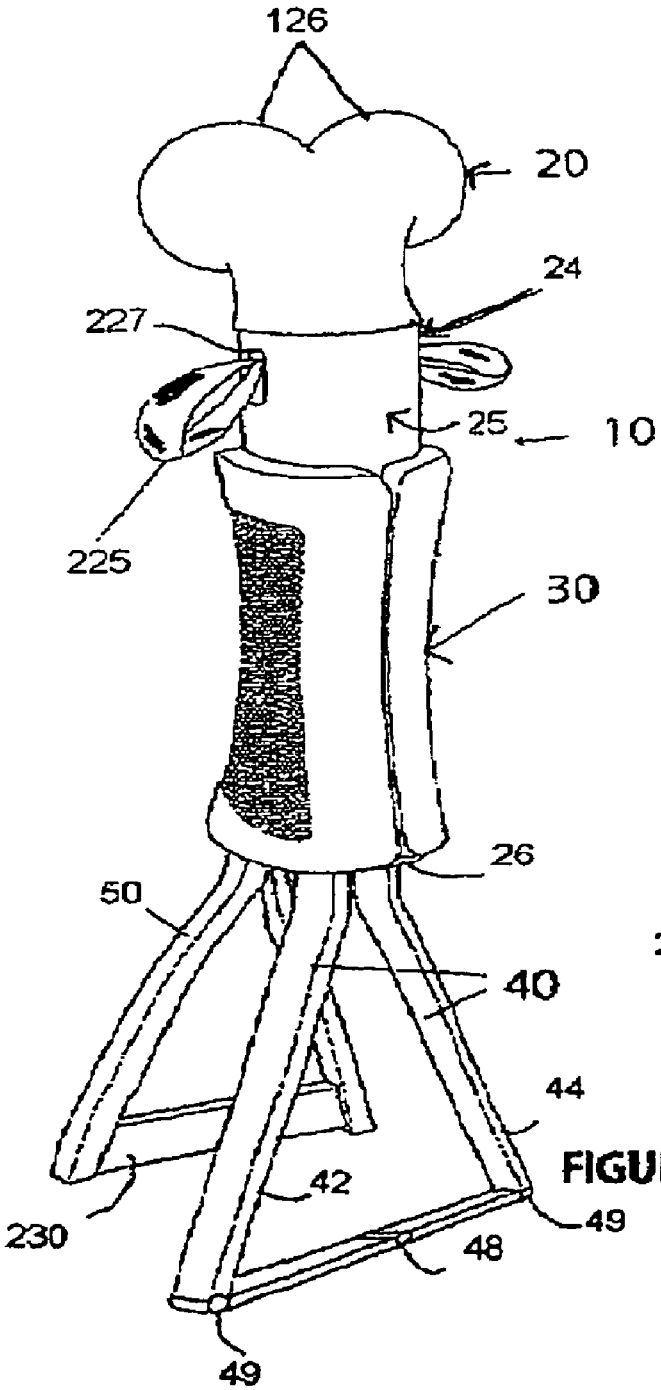
FIG. 1 is a perspective view of the present invention.
Figure 2:
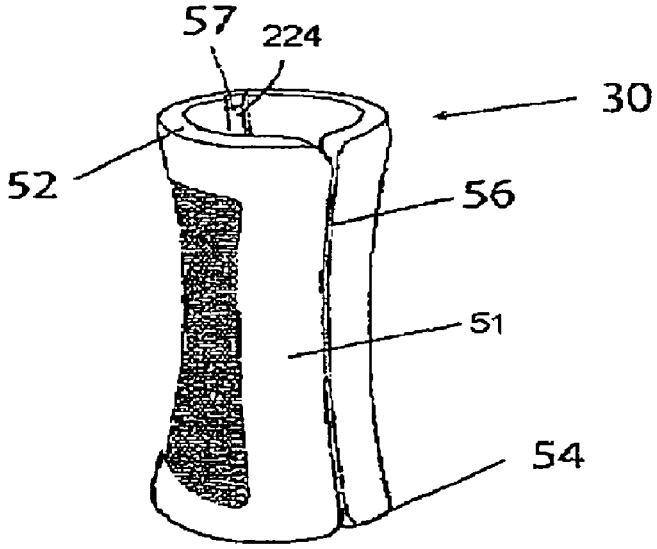
FIG. 2 is top view of the protective sleeve.
Figure 3A:
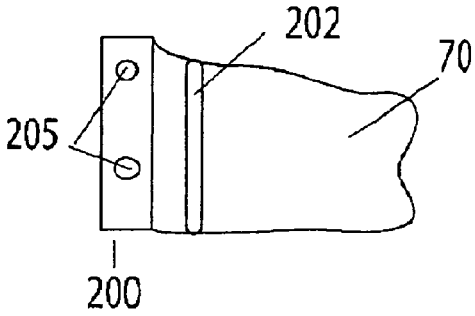
FIG. 3A is a side view of the bag.
Figure 3B:
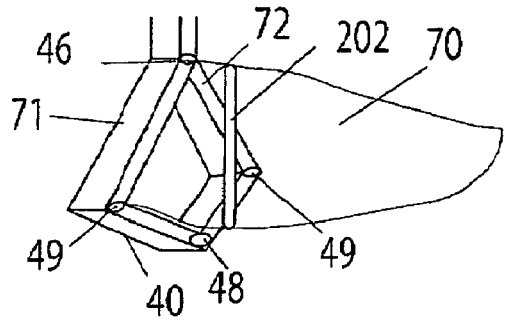
FIG. 3B is a side view of the bag attached to the bag holder in the closed position.
Figure 3:
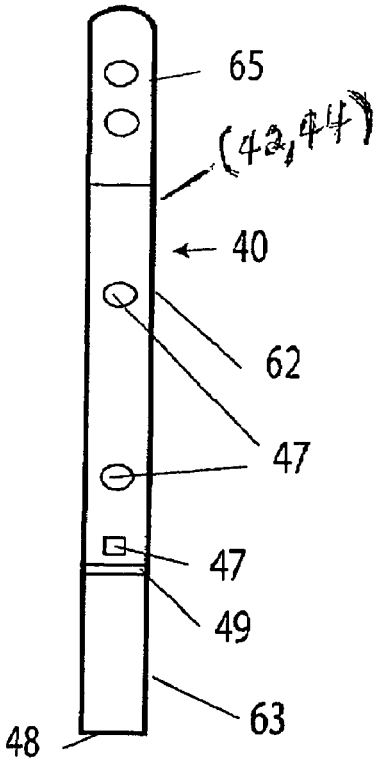
FIG. 3 is a side view of the bag holder.

Referring to FIG. 1-3, there is shown a current embodiment of the present invention, a refuse collector device, which is generally designated as reference numeral 10. As shown in FIG. 1, device (10) includes handle (20), shaft (25), protective sleeve (30), bag holder (40), and shovel (50).

Figure 1A:
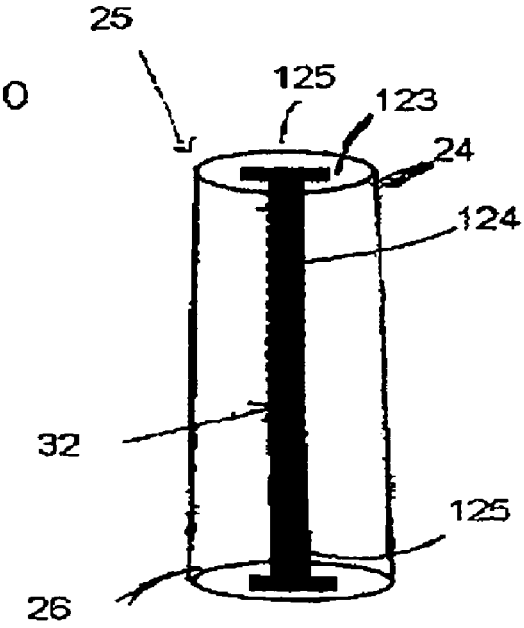
FIG. 1A is a side view of the shaft.

Referring to FIG. 1A, shaft (25) is further defined by an upper end (24) and lower end (26) with an internal bore (123) extending therethrough. A plurality of engaging members (32) extends vertically on the external surface of shaft (25). Each engaging member (32) further includes a track (124) protruding slightly outward from the external surface area and extending vertically from near upper end (24) to near lower end (26) of shaft (25). At each opposing end of track (124) is locking mechanism (125) protruding slightly outward from the external surface area and extending horizontally across a short predetermined distance. The plurality of engaging members (32) runs parallel to each other along the external surface area of shaft (25).

Handle (20) further comprises two integrally adjoined and opposed semi-circular shaped lobes (126). The semicircular shaped lobes (126) are conventionally called bone-shaped. Handle (20) is fixably mounted on upper end (24) of shaft (25). Handle (20) can be made of ivory or another suitable material. Handle (20) is specifically designed for aesthetic features.

Figure 2A:
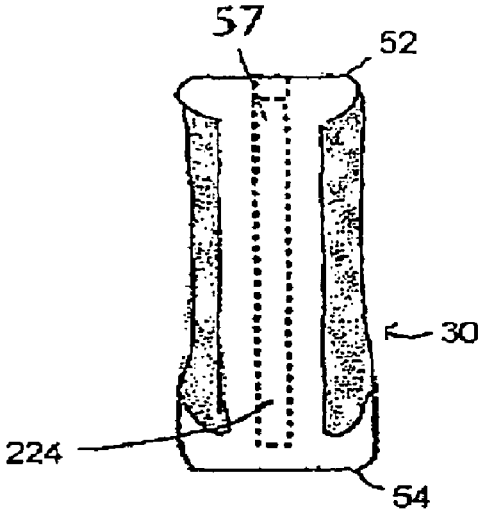
FIG. 2A is a side view of the protective sleeve.
Figure 2B:
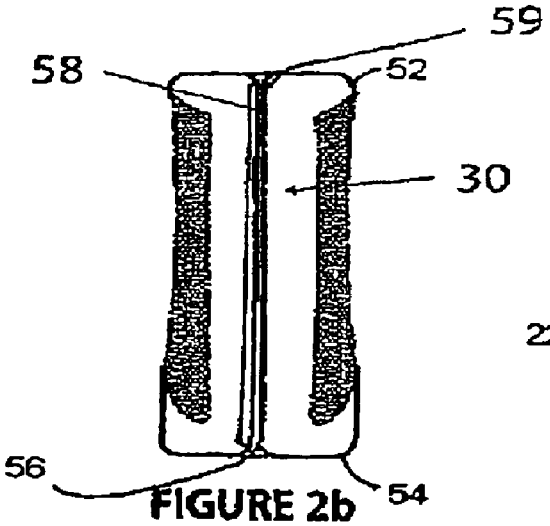
FIG. 2B is a front view of the protective sleeve.
Figure 2C:
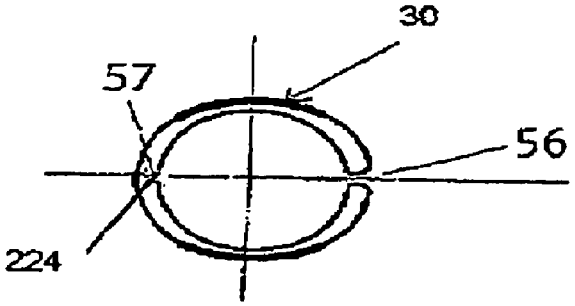
FIG. 2C is a top view of the protective sleeve.

As shown in FIG. 1, protective sleeve (30) is configured to slidably engage shaft (25). Referring to FIGS. 2-2C, there is shown an exploded view of protective sleeve (30). Protective sleeve (30) further comprises a cylindrical tubing (51) having a top end (52) and a bottom end (54). Cylindrical tubing (51) has a slightly larger diameter than shaft (25) with opening (56) extending from top end (52) to bottom end (54). A plurality of grooves (57) extends vertically on the internal surface of sleeve (30). Each groove (57) is designed to mate and engage with a corresponding engaging member 32 in FIG. 1A. As depicted in FIG. 2A-2C, each groove (57) further comprising a channel (224) adapted to slidably engage a track (124) depicted in and lock in place into locking mechanism (125) FIG. 1A. Groove (57) runs parallel to each other along the internal surface area of sleeve (30). Referring to FIG. 2B, lips (58, 59) are formed vertically along each opposing side of opening (56) of sleeve (30) and are faced inwardly towards the interior wall of sleeve (30).

Figure 6:
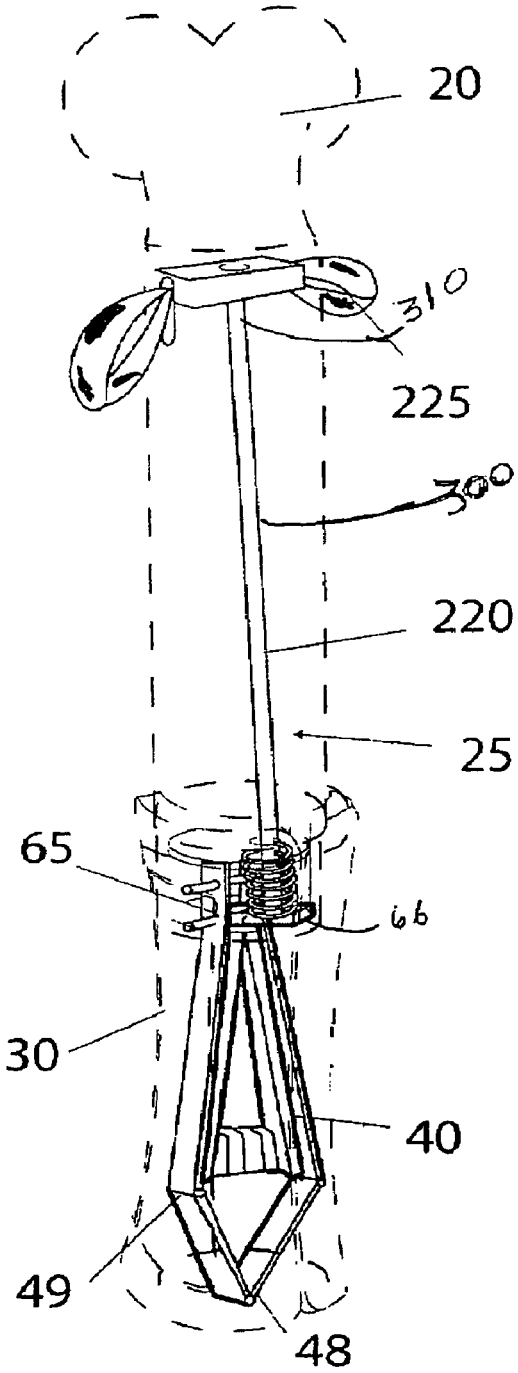
FIG. 6 is a perspective view of the non-operational mode of the present device without the bag.
Figure 6A:
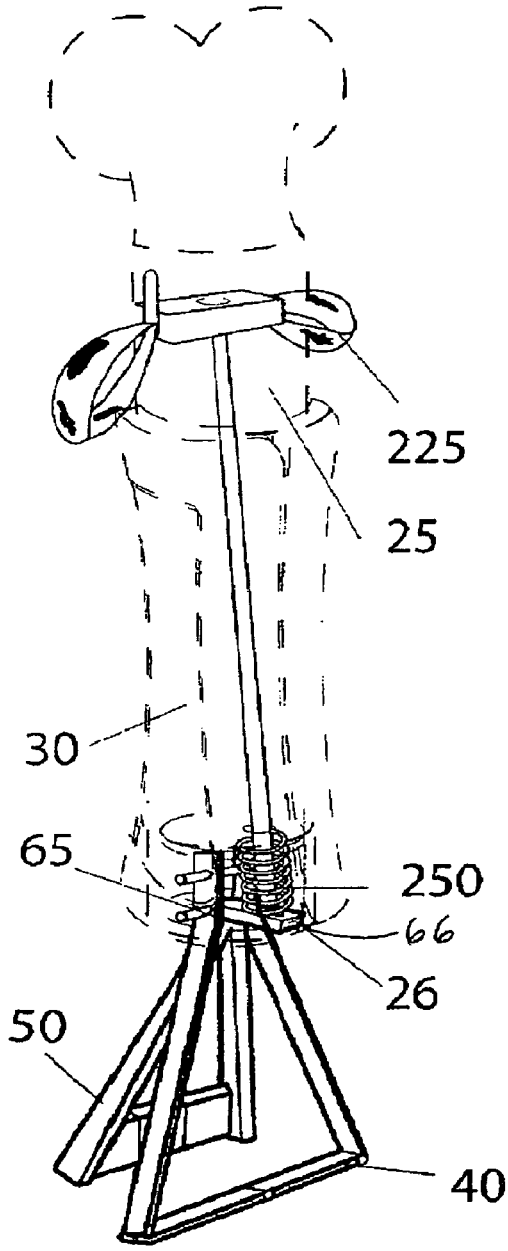
FIG. 6A is a perspective view of the operational mode of the present device without the bag.

As shown in FIG. 1 and FIG. 6A, bag holder (40) is pivotally attached to the lower end (26) of shaft (25) through bracket member (65). Referring now to FIGS. (3-3E), there is shown an exploded view of bag holder (40). Bag holder (40) includes a pair of equally sized elongated strip member (42, 44) connected at top end (46) and lower end (48). As shown in FIG. 3, each elongated strip member (42, 44) has a plurality of projecting tabs (47) externally mounted along its vertical axis. As shown, each elongated strip member 42 and 44 extend vertically downward. Each elongated strip member 42 and 44 can be made of strong durable material such as sturdy plastic, metal, or another such compatible material.

Figure 3C:
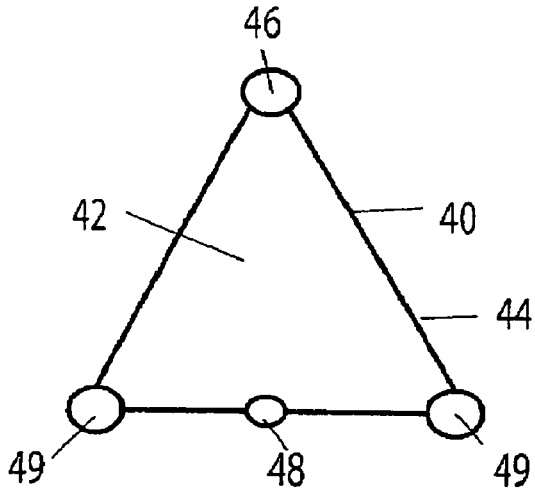
FIG. 3C is a front view of the opening of the bag holder.

Located near the distal end of each elongated strip member (42, 44) is breaking line (49) which extends horizontally across. Breaking line (49) separates each strip member (42, 44) into an upper end (62) and a lower end (63). As shown in FIGS. 3C and 3E, breaking line (49) allows lower end (63) to fold inward into a linear edge forming a triangular opening. Integrally formed above upper end (62) is bracket member (65). As shown bracket member (65) is pivotally connected to lower end (26) of shaft (25) utilizing conventional bolt screws. As sleeve (30) slides downwardly over shaft (25), lips (58, 59) slidably engage a corresponding elongated strip member (42, 44) as shown in FIG. 5A.

Bag (70) has an opening with opposing side edges (71, 72) adapted to connect to a corresponding elongated strip member (42, 44). As shown in FIG. 3A, each side edge 71 and 72 further comprises connector section (200) and sealing member (202). Connector section (200) and sealing member (202) lie adjacent to and parallel to each other. Connector section (200) extends outward and has apertures (205) along its vertical axis. Apertures (205) are adapted to securely engage projecting tabs (47) to secure bag (70) to bag holder (40) as shown in FIG. 3B. Each sealing member (202) has a complementary engaging seals internally mounted to each opposing side edge (71, 72).

Figure 4:
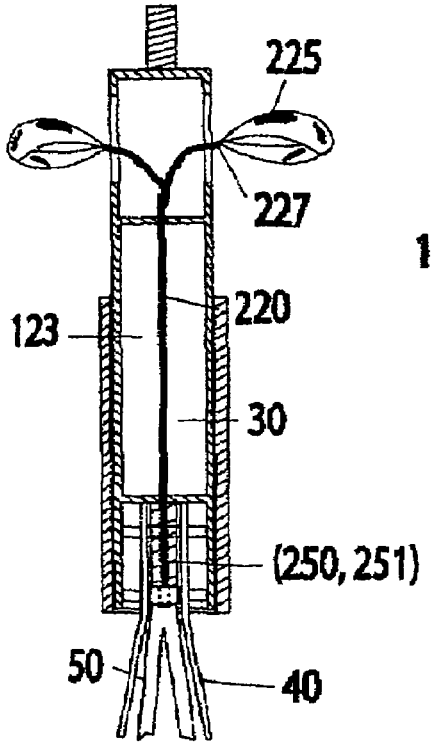
FIG. 4 is a cross-sectional view of invention with trigger.
Figure 4A:
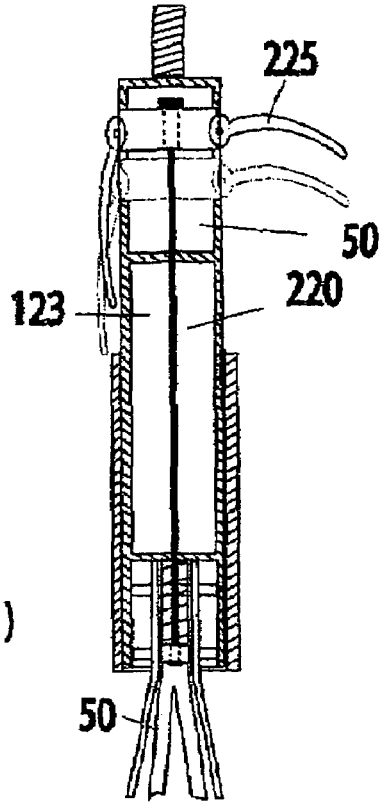
FIG. 4A is cross-sectional view of invention with trigger.
Figure 4F:
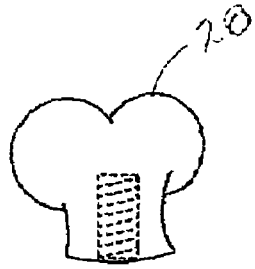
FIG. 4F is exploded top view of the handle.
Figure 4E:
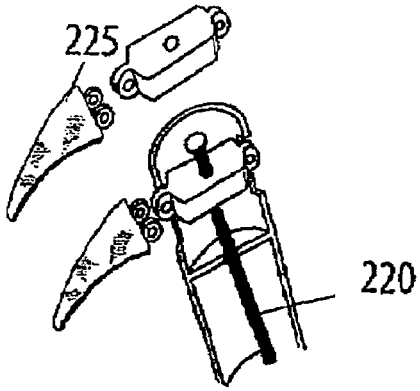
FIG. 4E is an alternative embodiment cross-sectional view of the actuator.
Figure 4B:
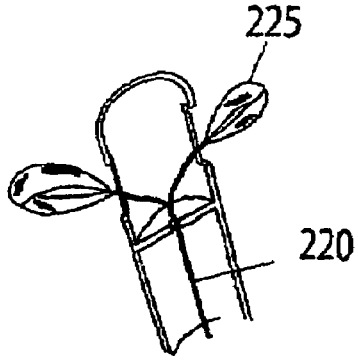
FIG. 4B is cross-sectional top view of trigger.

Referring to FIG. 4C and 4D, there is shown an exploded view of the shovel (50) as shown in FIG. 4 and 4A. Shovel (50) is pivotally connected to bottom of extension rod (220) facing bag holder (40). As shown in FIG. 4A and 4, extension rod (220) extends through the center bore of shaft (25) to shovel (50). The top end of rod (220) is attached to. Shovel control trigger (225) that connects to rod (220) through aperture (227). As shown in FIG. 4*c*, 4*d*, 6 and 6*a*, shovel pulley 66 is attached to the upper end of shovel (50) and allows shovel (50) to pivot back and forward upon spring 250 and 251. As shown in FIG. 4 and 4A, opposing springs (250, 251) are situated at the upper end of shovel (50). Control trigger (225) mechanically actuates shovel (50). When control trigger (225) is activated, shovel (50) springs forward to scoop up the waste and push the waste into bag (70). The operator manually pulls control trigger 225 upward, thereby causing shovel (50) to spring forward. FIG. 4E shows the bone handle disconnected from the top of the shovel.

As shown in FIGS. 6 and 6*a* there is shown an implementation of a conventional trigger mechanism (300) situated inside shaft 25 for the waste collector device, 10. The trigger mechanism (300) further comprises an upper bracket member (310).

Additionally, as shown in FIG. 4C and 4D, shovel (50) further comprises flexible elastic member (230) disposed at the lower end of the shovel scooper (53). Flexible elastic member (230) contracts as shovel (50) is pulled upward into sleeve (30) causing the left opposing strip member to be forced closer to the right opposing strip member (235) as shovel (50) is pulled upward into the sleeve (30) as shown in FIG. 5A and FIG. 6. Flexible elastic member (230) can be made of a naturally stretchable material like rubber or plastic or another suitable elastic material. As shown in FIG. 4D flexible elastic member 230 being disposed between opposing strip members (235) is adapted to expand into its natural position while extruded outside of sleeve (30) as shown in FIG. 6A. However, when shovel member (50) is retracted into sleeve (30) as shown in FIG. 6, opposing members 235 are forced towards each other causing flexible elastic member 230 to contract as shown in FIG. 4C. Opposing strip members (235) can be made of spring steel, fiberglass, plastic or any other suitable material which spring characteristics as shown in FIGS. 4*c* and 4*d*. Each opposing strip member (235) is configured to spring outwardly away from each other as sleeve (30) is pulled upward as shown in FIG. 6A. Yet, each opposing strip member (235) is configured to contract towards each other as shovel (50) is retracted into sleeve (30) allowing flexible elastic member (230) to contract.

Referring to FIG. 5A, there is shown device 10 in a closed position. In use, when device (10) is in a closed non-operational storage position, the protective sleeve (30) protects the mechanical elements of shovel (50) and the bag holder (40). As shown in the closed position protective sleeve (30) is slid downward on shaft (25) to enclose shovel (50) and bag holder (40). As protective sleeve (30) is pulled downward, lips (58, 59) are configured to securely engage bag (70) complementary seals of sealing members (202) such that bag (70) are securely locked. When device (10) is in a closed position, track (124) of each engaging member (32) is engaged and locked into position with a corresponding channel (224) of groove (57).

Figure 5:
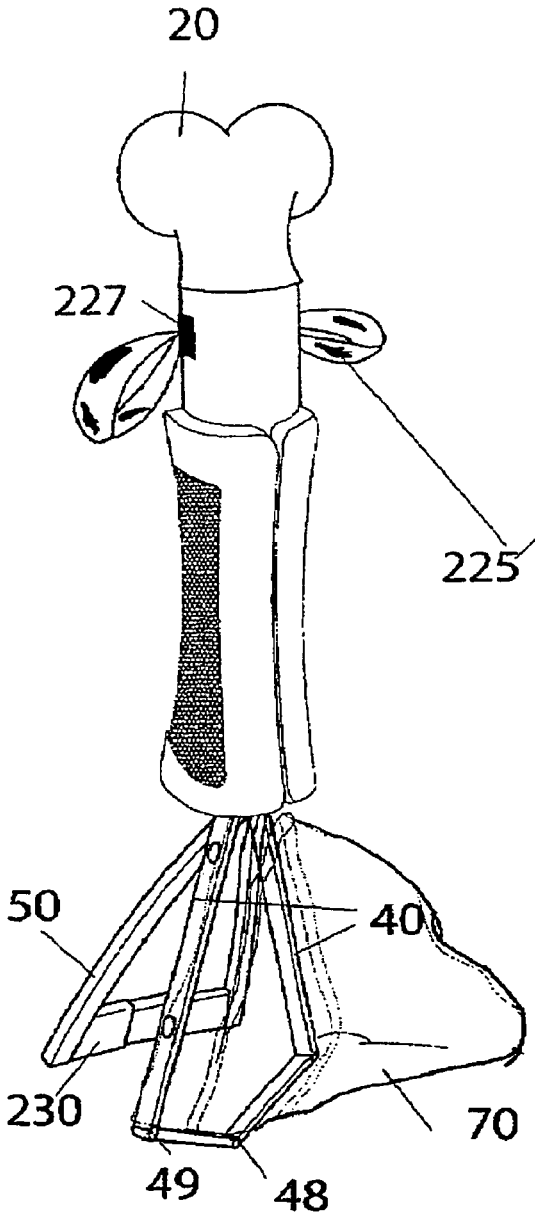
FIG. 5 is a perspective operational mode view with the bag opened.
Figure 5A:
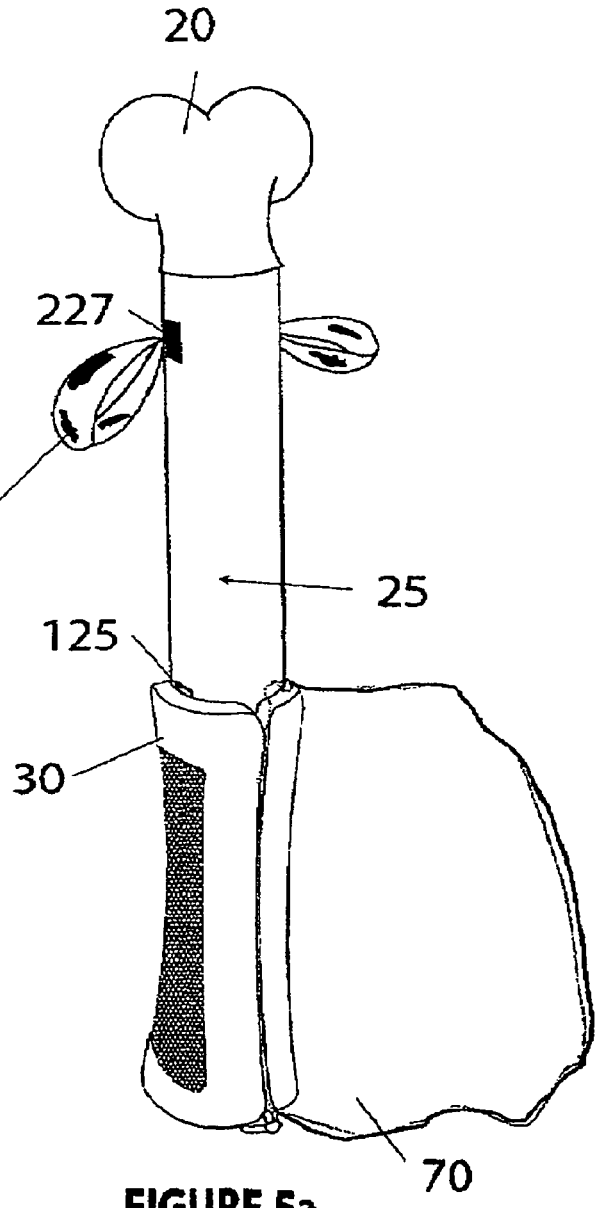
FIG. 5A is a perspective non-operational mode with the bag closed.

As shown in FIG. 1 and 5, when device (10) is in an operational position, protective sleeve (30) is slid upward along shaft (25), shovel (50) and bag holder (40) become exposed. If there is no attached bag, bag (70) is attached to bag holder (40) by engaging projecting tabs (47) with apertures (205) shown in FIG. 3E.

As protective sleeve (30) is slid upward, track (124) of each engaging member (32) is disengaged from its corresponding channel (224). Additionally, if bag (70) is attached to bag holder (40) in the closed position, as sleeve (30) is slid upward, bag (70) sealing members (202) are disengaged. Then, at a predetermined position on the ground near waste, the lower end (48) of bag holder (40) is aligned perpendicular to the ground. Then, handle (20) is depressed downward causing lower end (48) of bag holder (40) to fold upward into a linear edge. Each opposing breaking line (49) of bag holder (40) forms a triangular shape opening as shown in FIG. 3E. Then, trigger (225) is actuated to allow shovel (50) to spring forward scooping the waste into bag (70). After the waste is scooped into bag (70) as shown in FIG. 6A, protective sleeve (30) is slid downward sealing bag (70) and placing device (10) back into a closed position as shown in FIG. 6.

What is claimed is:

1. A refuse collector device for collecting feces waste material from the ground comprising:

a shaft having an upper end and a lower end with an internal bore extending therethrough;

an extension rod extending through the internal bore from the upper end to the lower end of the shaft, the extension rod defined by a top and a bottom;

a handle fixably mounted to the upper end of the shaft;

an actuator device operationally mounted to the handle and operationally connected to the top of the extension rod;

a protective sleeve configured to surround and to slidably engage with the shaft;

a bag holder having a pair of opposing elongated strip members; the bag holder being pivotally mounted to the lower end of shaft; and a shovel pivotally connected to the bottom of extension rod with an angular relationship facing away from the bag holder in a non-operational position, the protective sleeve being adapted to slide downward encapsulating the shovel and the bag holder;

in an operational position, the protective sleeve being adapted to slide upward wherein the shovel being released into pivotally angular connection facing away from the bag holder, the elongated strip members being adapted to form a triangular opening position directly in front of the shovel such that when activated by a user the actuator device causes the shovel to automatically move forward scooping the feces waste material up and into a bag member coupled to the bag holder.

2. The device of claim 1 wherein the shaft further comprises:

a plurality of engaging members extending vertically along a predetermined external surface area of the shaft; the plurality of engaging members running parallel to each other along the predetermined external surface area of the shaft.

3. The device of claim 2 wherein each engaging member further comprises:

a track extending vertically from substantially near the upper end of the shaft to near the lower end of the shaft;

the track protruding slightly outward from near the predetermined external surface area; and at each opposing end of the track a locking mechanism protrudes slightly outward from the predetermined external surface area and extend- horizontally across therefrom a short predetermined distance.

4. The device of claim 2 wherein the protective sleeve further comprises:

a cylindrical tubing defined by a top end and a bottom end;

the cylindrical tubing having a slightly larger diameter than the shaft and a slit extending from the top end to the bottom end thereon defining an opening within the cylindrical tubing; and a plurality of grooves running parallel to each other along a predetermined internal surface area and extending vertically therefrom along on a predetermined internal surface area of cylindrical tubing wherein each groove is designed to mate and engage with a corresponding engaging member.

5. The device of claim 4 wherein each groove further comprises a channel adapted to slidably engage with a corresponding track and lock in place into the locking mechanism.

6. The device of claim 5 wherein the bag holder further comprises:

the triangular opening facing the shovel providing an entry way for the feces into the bag member while in operational mode;

the triangular opening vertically extending from a top end to a lower end when in a non-operational mode;

the pair of elongated strip members each with a vertical axis forming the triangular opening;

each elongated strip member having a plurality of projecting tabs externally mounted along the vertical axis;

each elongated strip member extends vertically downward therefrom;

a breaking line forming a first pivot point located substantially near a distal end of each elongated strip member and extends horizontally across therefrom;

the breaking line separating each strip member into an upper end and a lower end;

the lower end of the triangular opening adapted to be a second pivot point;

as the bag holder is placed downward upon a substantially flat surface forcing the breaking line and the lower end to pivot inward into a linear edge wherein the triangular opening is formed;

and the plurality of projecting tabs providing an engaging and disengaging mechanism adapted to engage with an entry opening of the bag member.

7. The device of claim 6 wherein the engaging and disengaging mechanism further comprises:

in a closed position, as the protective sleeve slides downwardly over the shaft, the pair of lips simultaneously and securely engage the entry opening of the bag member.

8. The device of claim 6 wherein the bag member further comprises:

the entry opening providing an entry way into the bag member with a pair of second elongated strip members attached thereto;

each second elongated strip member having a vertical axis with a second fastener attached thereto;

the second fastener disposed adjacent and parallel to each second elongated strip member and the second fastener adapted to engage with the projecting tabs to secure the bag member onto the bag holder.

9. The device of claim 4 further comprising a pair of lips formed vertically along each opposing side of the opening of the cylindrical tubing and facing inwardly towards the interior wall of the cylindrical tubing.

10. The device of claim 1 wherein the shovel further comprises:

a pair of opposing strip members having an upper end with each end converging together and a lower end diverging with each end diverging away from each other the upper end of the pair of opposing members pivotally connected to the bottom end of the extension rod and extending linearly downward there from;

a flexible member horizontally disposed and sandwiched between a lower end of the pair of opposing members;

the opposing strip members adapted to contract as the shovel is encapsulated by the protective sleeve as the shovel is pulled upward into the protective sleeve;

the flexible member adapted to contract as the shovel is pulled upward into the protective sleeve; and the flexible member adapted to expand as the shovel is released from the protective sleeve.

* * * * *